US007441604B2

(12) United States Patent
Green

(10) Patent No.: US 7,441,604 B2
(45) Date of Patent: Oct. 28, 2008

(54) FRACKING MULTIPLE CASING EXIT LATERALS

(75) Inventor: Rickey J. Green, Williston, ND (US)

(73) Assignee: Baker Hughes Incorporated, Houston, TX (US)

( * ) Notice: Subject to any disclaimer, the term of this patent is extended or adjusted under 35 U.S.C. 154(b) by 326 days.

(21) Appl. No.: 11/258,811

(22) Filed: Oct. 26, 2005

(65) Prior Publication Data

US 2007/0158073 A1 Jul. 12, 2007

(51) Int. Cl.
*E21B 43/14* (2006.01)
*E21B 43/25* (2006.01)

(52) U.S. Cl. ..... 166/308.1; 166/313

(58) Field of Classification Search ..... 166/313, 166/308.1, 50, 177.5
See application file for complete search history.

(56) References Cited

U.S. PATENT DOCUMENTS

| | | | | |
|---|---|---|---|---|
| 4,022,279 | A * | 5/1977 | Driver | 166/271 |
| 5,520,252 | A | 5/1996 | McNair | |
| 5,715,891 | A | 2/1998 | Graham | |
| 5,960,873 | A * | 10/1999 | Alexander et al. | 166/50 |
| 6,446,727 | B1 | 9/2002 | Zemlak et al. | |
| 6,615,920 | B1 | 9/2003 | Collins et al. | |
| 6,712,148 | B2 * | 3/2004 | Fipke et al. | 166/381 |
| 2006/0124310 | A1 | 6/2006 | Lopez de Cardenas | |

* cited by examiner

*Primary Examiner*—Hoang Dang
(74) *Attorney, Agent, or Firm*—Steve Rosenblatt

(57) ABSTRACT

A method of fracking multiple laterals sequentially is described. It allows the drilling rig to be moved off site as the laterals are fracked. Thereafter, they can all be produced simultaneously. The laterals begin from a main lateral that is already oriented in the producing zone and preferably exit in a coplanar manner so as to extend immediately into the producing formation.

20 Claims, 7 Drawing Sheets

FRACKING MULTIPLE CASING EXIT LATERALS

FIELD OF THE INVENTION

The field of the invention is fracking multiple casing exits in a single procedure without having the need for a drilling rig present.

BACKGROUND OF THE INVENTION

In the past, the process of drilling laterals was interrupted by fracking the lateral just drilled. In this technique, the drilling rig would drill the main lateral through a shoe in the main bore and then drilling was shut down to perform the fracking on the lateral just drilled into the producing formation. Thereafter, that main lateral was plugged. A whipstock was set higher and a second lateral was drilled from the main bore to exit vertically and eventually enter the producing zone. After the second lateral was drilled it would be temporarily plugged and the drilling rig moved off location. A workover rig was brought on location and the plug was pulled out of the second lateral so that a sand frack in the second lateral could take place. The second lateral would be flowed or produced until depleted to the point where another rig could be brought in to pull the plug from the main lateral so as to allow the main lateral to be produced through a production string tagged into a production packer. After the main lateral was substantially depleted, the tubing to the packer in the main lateral could be perforated so that both laterals could be produced together. The problem with this method was the high cost of keeping the drilling rig around while the main lateral was fracked and plugged. Spacing the frack jobs in time also incurred incremental costs as compared to a frack job on two laterals, if the two laterals could somehow be fracked one after the other.

To address some of these cost issues a different method was devised. The main lateral was again drilled through the shoe of the main bore and lined, if required. As shown in FIG. 1, the main lateral 10 extends from main bore 12. Optionally, a liner such as perforated liner 14 could be run into lateral 10. A wireline cement bond log could be performed and thereafter a retrievable packer 16 could be run in on wireline and set. Preferably the packer 16 has a seal bore 18 to accept a whipstock 20 as shown in FIG. 2. The packer 16 also has a removable plug 19. After inserting the whipstock 20 the vertical lateral 22 is drilled off the main vertical bore 12. Lateral 22 can also optionally be lined with a liner such as perforated liner 24. The whipstock 20 is then retrieved. The packer can be cleaned out using a cleanout tool (not shown) that is delivered on drill string combined with circulation. After the cleanout tool and delivery drill pipe are removed a top packer 26 connected to a ported sub 28 is tagged into the lower packer 16 as shown in FIG. 3. After packer 26 is set, the drill pipe is removed from the well and the drilling rig is rigged down after a wellhead gate valve (not shown) is installed. A pump truck is hooked up and builds pressure to expel a plug 19 in lower packer 16. The main lateral 10 is then fracked. A shifting plug such as a dart is delivered to obstruct lateral 10 while operating the ported sub 28 to provide access to lateral 22 that is now straddled between packers 16 and 26. Pressure on the seated plug shifts the ported sub 28 to open the access to lateral 22. Lateral 22 is now fracked and the well is shut in and the fracking equipment is moved off site. A wireline lubricator is mounted on the wellhead and the plug previously delivered to operate the ported sub 28 is retrieved with known fishing tools. At this point both laterals can be produced through packer 26 either right up the casing, if local laws permit, or through production tubing (not shown) that is tagged into packer 26. The full layout of the producing assembly, without production tubing, is shown in FIG. 4.

There were issues with this procedure mainly stemming from the fact that the lateral 22 had to go vertically through other formations before reaching the producing zone where lateral 10 was disposed. In the vertical run there could be unconsolidated zones or zone that produced water, forcing complex and costly completion procedures before lateral 22 could be produced. These expenses are avoided by the present invention that allows additional lateral exits to be coplanar with the main lateral. As will be described below, one or more laterals can be made from a main lateral already in the producing zone. The laterals can all be drilled with a drilling rig that is then removed and the laterals can then be sequentially fracked. Thereafter, the laterals can be produced together, if desired. These and other advantages of the present invention will be more apparent to those skilled in the art from a review of the description of the preferred embodiment, the drawings and the claims below, which define the scope of the invention.

SUMMARY OF THE INVENTION

A method of fracking multiple laterals sequentially is described. It allows the drilling rig to be moved off site as the laterals are fracked. Thereafter, they can all be produced simultaneously. The laterals begin from a main lateral that is already oriented in the producing zone and preferably exit in a coplanar manner so as to extend immediately into the producing formation.

DETAILED DESCRIPTION OF THE PREFERRED EMBODIMENT

Figure 1:
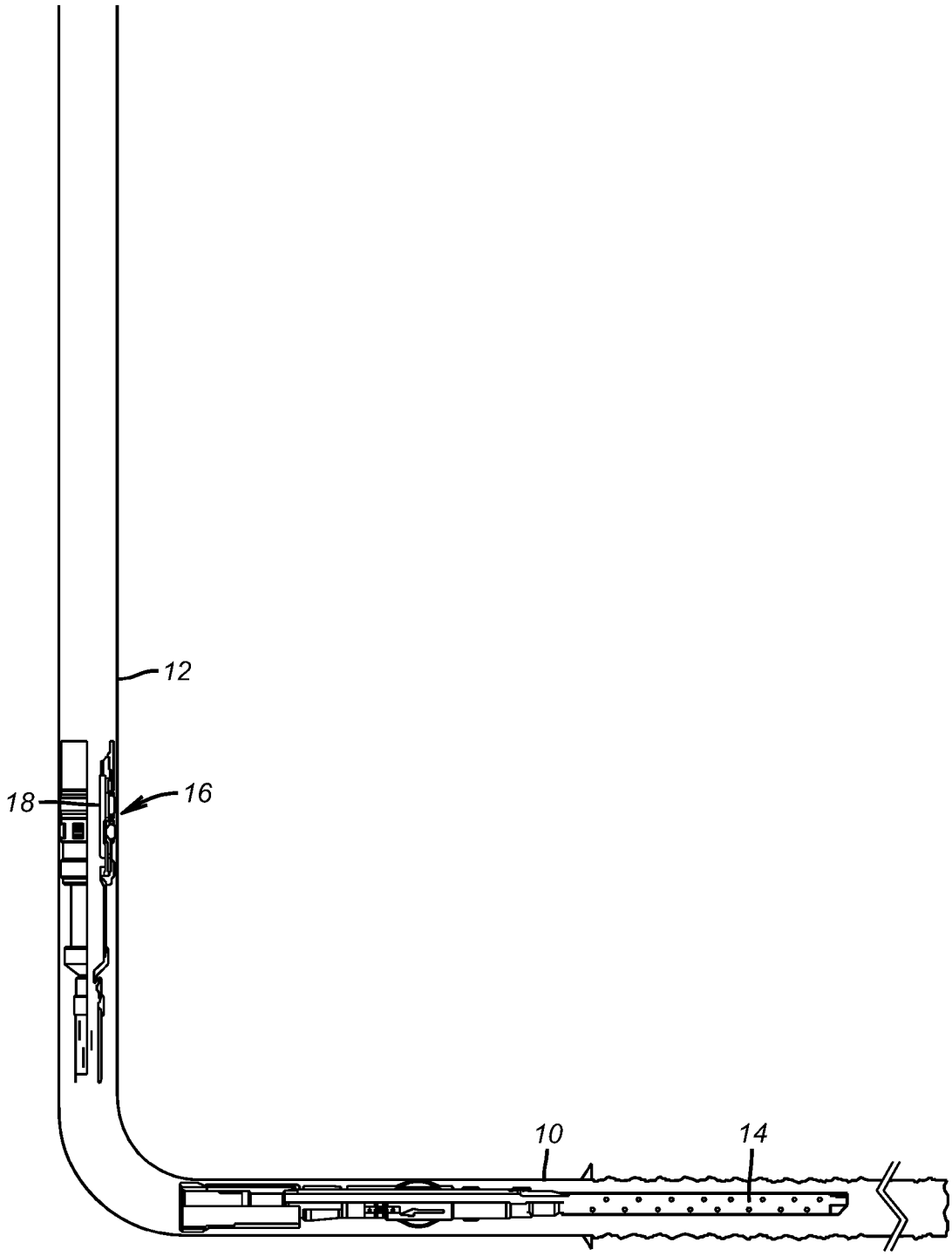
(PRIOR ART) FIG. 1
FIG. 1 illustrates a prior art method where a main lateral is drilled from a vertical main bore.
Figure 2:
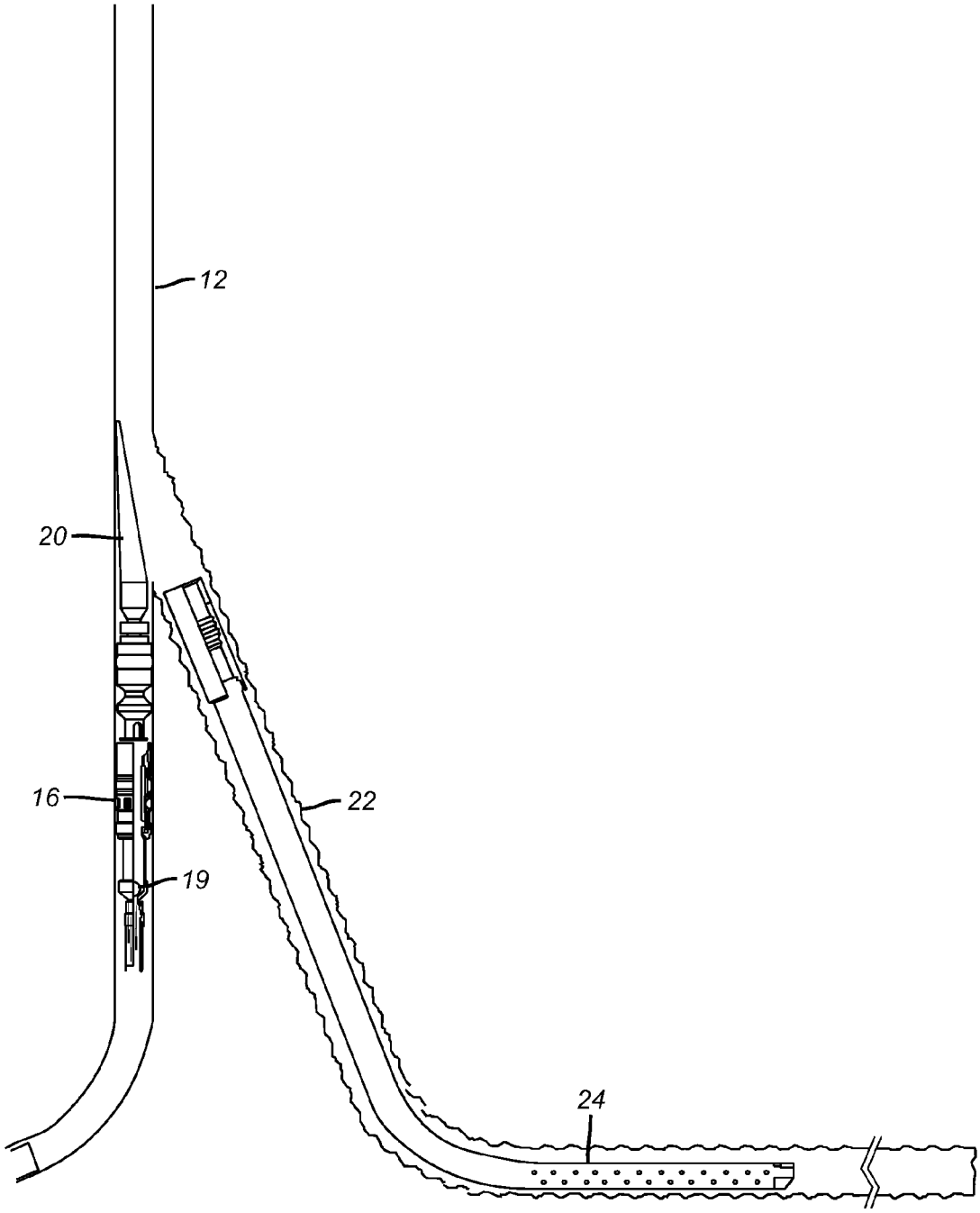
(PRIOR ART) FIG. 2
FIG. 2 continues the prior art method of FIG. 1 where a vertical lateral is drilled off a window in the vertical main bore.
Figure 3:
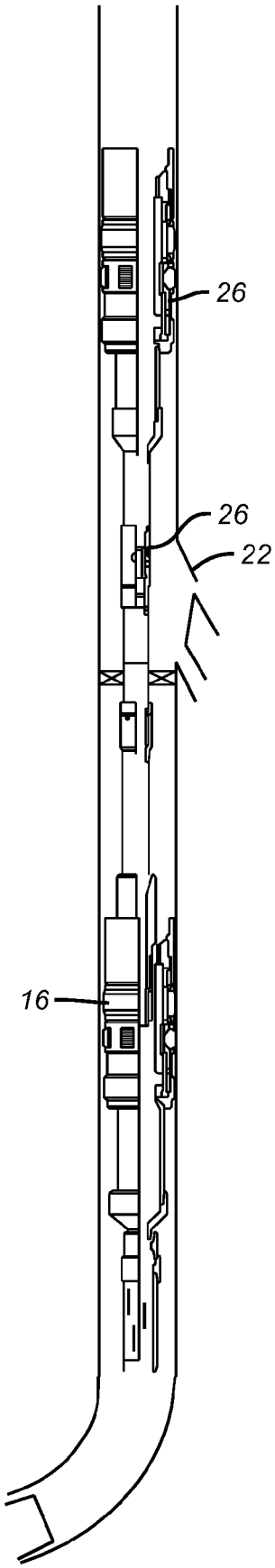
(PRIOR ART) FIG. 3
FIG. 3 continues the prior art method of FIG. 2 and shows the fracking equipment in position for fracking the laterals after all drilling has concluded.
Figure 4:
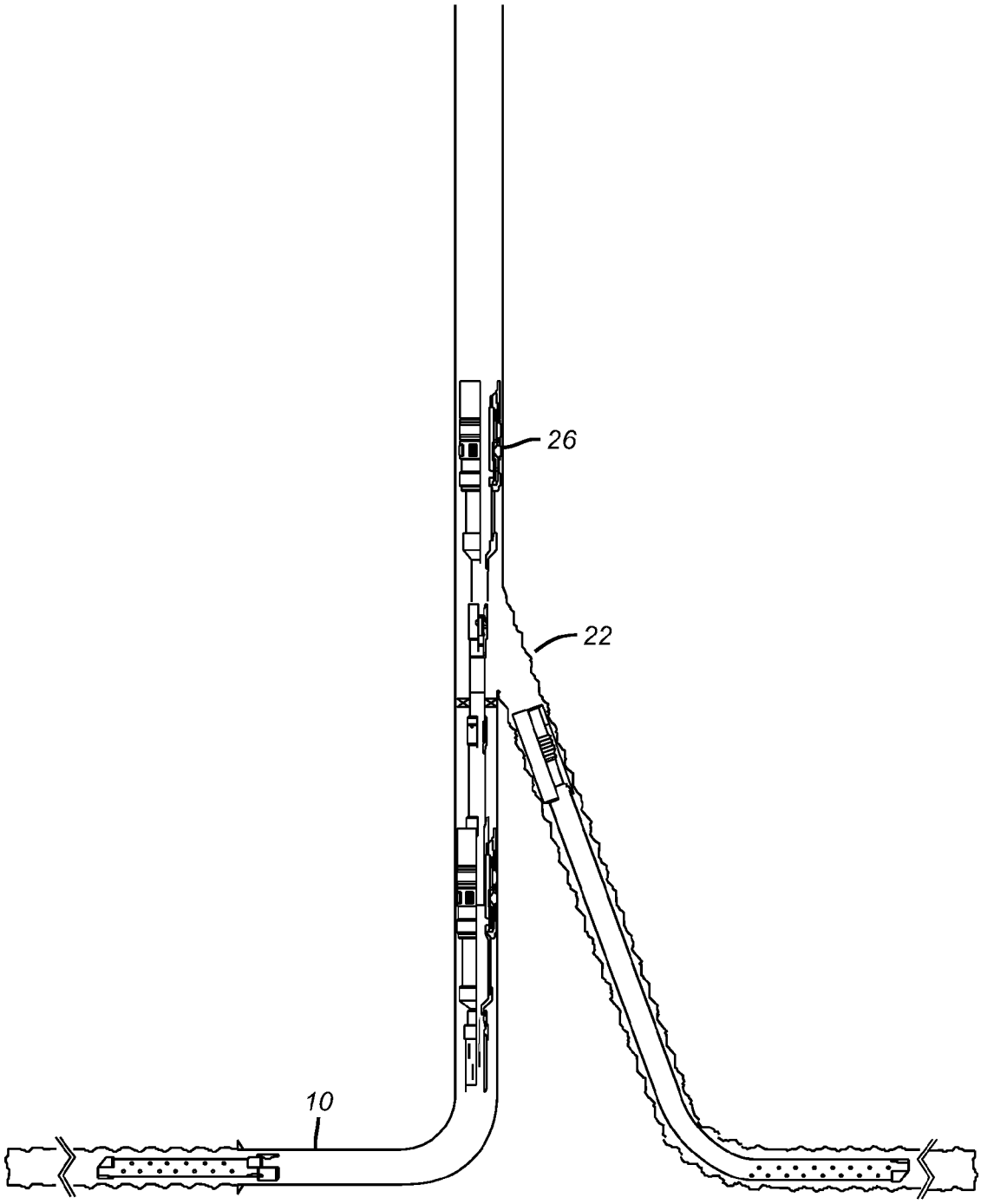
(PRIOR ART) FIG. 4
FIG. 4 is an overall view of the prior art method after fracking and shown ready to produce from the laterals.
Figure 5:
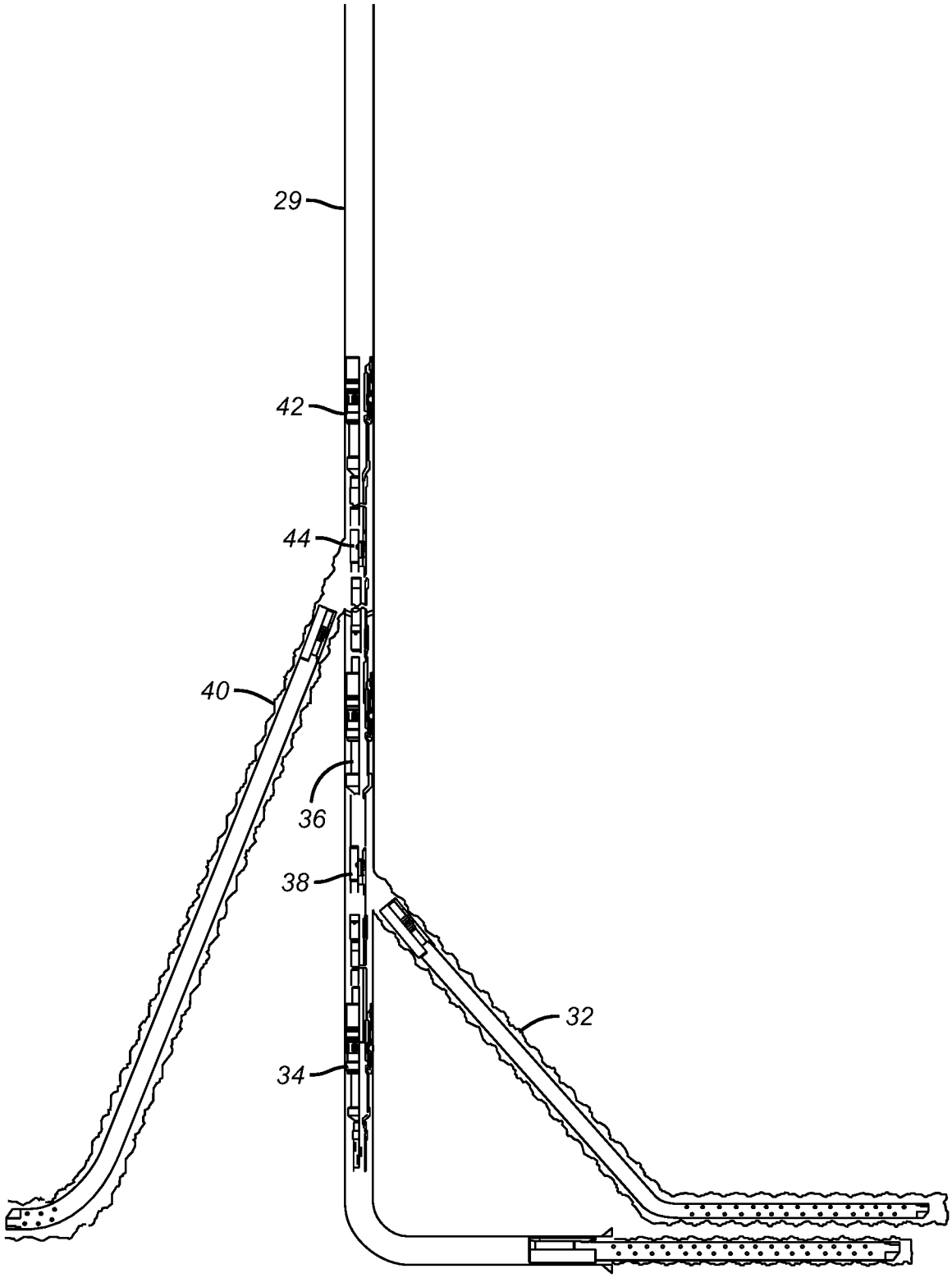
FIG. 5 is an improvement to the prior art method shown in FIGS. 1-4.

FIG. 5 is an improvement over the method of FIGS. 1-4 previously described. The method is identical for the drilling of the laterals 30 and 32 and in the use of the packers 34 and 36 and the ported sub 38 between them. Packer 34 has a plug 35 that is later blown out at the start of fracking. The difference starts when after drilling the lateral 32 and setting the packer 36 the packer 36 gets a plug and another whipstock (not shown) is tripped into it to allow the final lateral 40 to be drilled. If required, the lateral 40 is lined and the whipstock is removed and a cleanout process using circulation takes place adjacent packer 36. Thereafter an assembly comprising another packer and a ported sub 44 are tagged into packer 36.

With packer 42 set, the fracking can begin, after plug 35 is blown out, and there is no need for the drilling rig or a workover rig to do the fracking. Now with ported subs 38 and 44 both closed to laterals 32 and 40 respectively, a plug dropper is connected at the wellhead and the fracking of the main lateral 30 begins. When the lateral 30 is done, a plug is dropped into ported sub 38 to close off lateral 30 and to open access to lateral 32. Lateral 32 is now fracked in a similar manner and when that step is concluded another plug is dropped to land in ported sub 44 to shift it to the position where lateral 40 is exposed and packer 36 is closed, in effect isolating both laterals 30 and 32. Lateral 40 is now fracked and at the conclusion of the fracking, the fracking equipment is removed. A wireline unit is placed into position and a lubricator is installed at the wellhead in a known manner. The plugs previously dropped to actuate the ported subs 38 and 44 are retrieved with known fishing tools. Alternatively the plugs may be blown through seats or otherwise removed such as by dissolving or chemical attack or mechanical impact or other ways equivalent. With the ported subs 38 and 44 having their lateral ports open and the associated dropped plugs removed, there is now access to all laterals 30, 32 and 40. The well can be produced through the casing if permitted by local regulation or a production string can be run into packer 42 and all three laterals can be produced simultaneously.

Here again, the fact that vertical exits from the main bore 29 in the form of laterals 32 and 40 must travel through other zones before reaching the producing zone where lateral 30 is disposed creates a potential problem if the intervening zones are problem zones that will require a cemented liner or some other expensive completion. The advantage over the method in FIGS. 1-4 is that additional laterals are possible through the use of isolation plugs that are of different sizes to first isolate lateral 30 so that lateral 32 can be fracked and then, using a larger plug to effectively isolate laterals 30 and 32 from lateral 40 so that it can then be fracked. Here again, the drilling rig or a workover rig is not needed after all the drilling is done for the laterals and the fracking process can take place using a much cheaper pressure unit to do the fracking.

Figure 6:
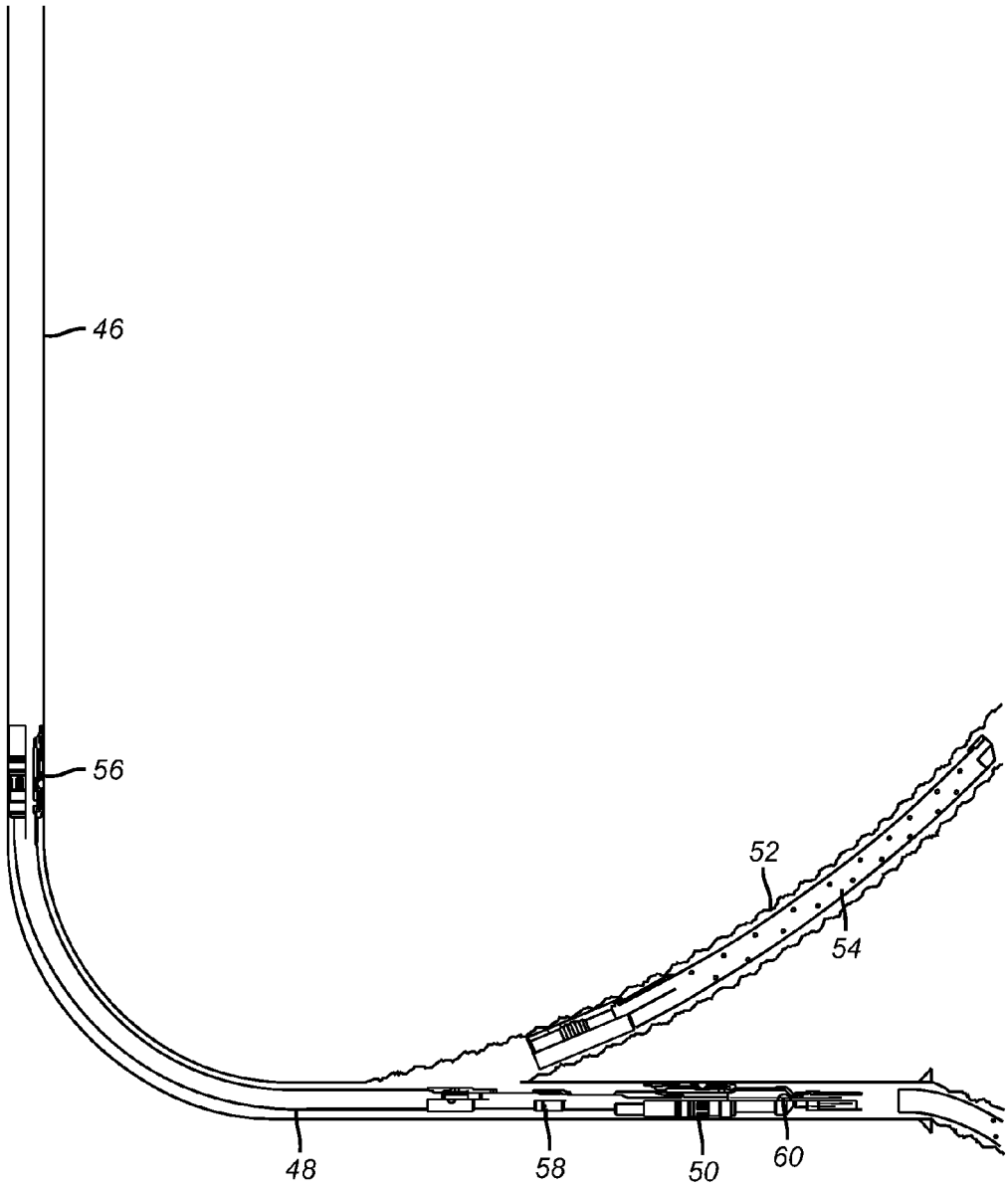
FIG. 6 illustrates a coplanar lateral from a main lateral going directly into the producing formation.
Figure 7:
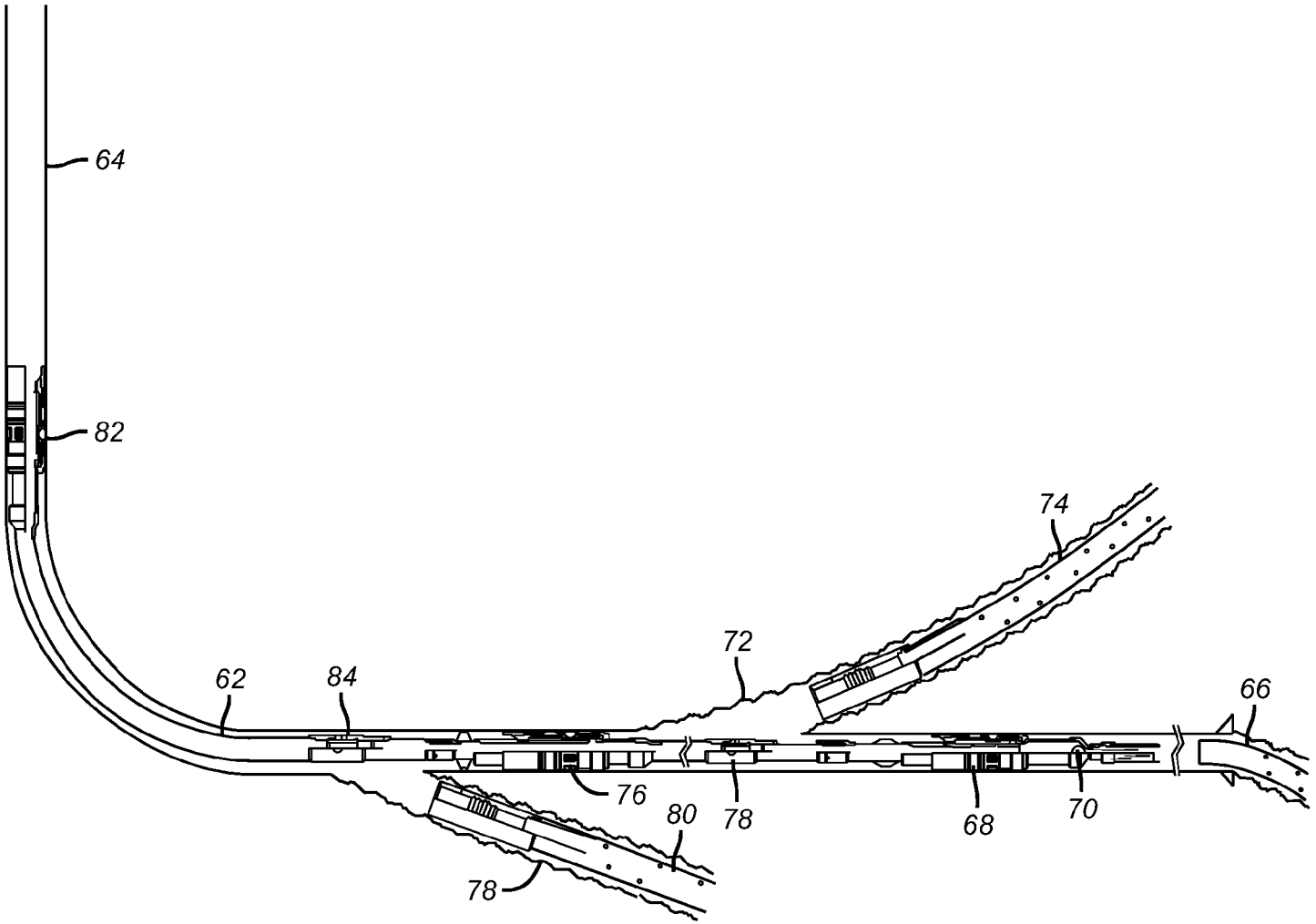
FIG. 7 illustrates the method of FIG. 6 showing multiple coplanar lateral from he main lateral going directly into the producing formation.

FIGS. 6 and 7 illustrate a modification of the method to promote the use of coplanar laterals from the main lateral instead of the previous techniques that involved vertical laterals from the main vertical bore. The main advantage here is that the drilled laterals go directly into the producing zone of interest from the main lateral and thus avoid the risks inherent in vertical lateral exits that have to go through other formations to get to the producing formation and could necessitate undue expenses for completions on those laterals to deal with issues such as a water producing zone or an unconsolidated zone.

FIG. 6 shows the main vertical bore 46 from which the main lateral 48 is drilled into the producing formation. This lateral can be lined if required. After the lateral 48 is drilled, a packer 50 is inserted and set. As before, this packer 50 can receive a whipstock to facilitate drilling the lateral 52 that exits in a coplanar orientation from lateral 48. Optionally lateral 52 can be lined such as with the perforated liner 54. After the lateral 52 is drilled the cleanup tool and circulation are used to clean up around packer 50. Thereafter, an upper packer 56 and a ported sub 58 are tagged into packer 50 and the upper packer 56 is set. At this time the drilling rig is no longer required. A pressure truck is rigged to the wellhead to blow out a plug 60 from packer 50. At this time lateral 48 is ready for fracking. At the conclusion of fracking lateral 48 a ball is dropped into the ported sub 58 to close off lateral 48 while opening access to lateral 52. Packers 56 and 50 straddle the lateral 52. Lateral 52 can now be fracked after which the well is shut in and the fracking equipment is rigged down. Production can now commence from both laterals with production from lateral 48 bringing off its seat the plug dropped into ported sub 58 to shift it. The well can be produced through the casing or production tubing can be tagged into packer 56 before production commences.

FIG. 7 is similar to FIG. 6 except multiple coplanar laterals emerge from the main lateral directly into the producing formation. First the main lateral 62 is drilled from he vertical bore 64 and lined, if required using a liner 66. A packer 68 with a plug 70 is inserted and set in the main lateral 62. A whipstock (not shown) is tagged into packer 68 and the lateral 72 is drilled and optionally lined with a liner 74. The whipstock is removed and the top of packer 68 is cleaned with circulation and a cleanup tool. A straddle assembly featuring a packer 76 and a ported sub 78 are tagged into packer 68. This time a whipstock is tagged into packer 76 so that lateral 78 can exit in a coplanar manner with lateral 62. Lateral 78 can optionally be lined with liner 80. The whipstock is then removed and the top of packer 76 is cleaned up with a cleanup tool. Thereafter, an assembly of packer 82 and ported sub 84 are tagged into packer 76. The drilling rig can be removed and a pressure unit hooked up. The plug 70 is blown out of packer 68. Lateral 62 is aligned for fracking. When lateral 62 is fracked, a ball is dropped into ported sub 78 to effectively isolate main lateral 62 and open access to lateral 72, which is then fracked. After that, another larger ball is landed in ported sub 84 to shift it and to isolate both laterals 62 and 72 from lateral 78 that is now open to the ported sub 84. Lateral 84 can now be fracked. The fracking equipment can now be rigged down. All laterals can be immediately produced. Production brings up off their seats the balls dropped into ported subs 84 and 78. Production can be through casing, if permitted, or a production string can be tagged into packer 82.

Those skilled in the art will appreciate that the methods of FIGS. 5-7 offer advantages over the prior techniques described above and shown in FIGS. 1-4. As to the FIG. 5 method three or more laterals can be drilled with the drilling rig. These three laterals can be sequentially fracked without the use of the drilling rig or a workover rig. The use of different sized plugs allows sequential operation of the ported subs 38 and then 44 to effectively isolate laterals to allow for the sequential fracking of three or more laterals, a method not known and different than the illustrated prior method of FIGS. 1-4. Also unique is the ability to produce three or more laterals immediately and at the same time.

The method of FIG. 6 illustrates the added advantage of having two laterals coplanar while still having the advantage of sequential fracking without using a drilling rig and still having the ability to produce all laterals at the same time immediately. The FIG. 7 design takes the method a step further illustrating a technique where three or more laterals can be coplanar while having the other stated advantages from the method. The use of coplanar or nearly coplanar exits, particularly where subsequent laterals come off of a main lateral that is already in the producing zone, avoids the risk of having laterals pass through unstable or unconsolidated zones that could require expensive completions in any particular lateral.

It should be noted that "coplanar" is used in a broad sense of having laterals go directly into an adjacent producing zone that is disposed adjacent to where such laterals begin or pass through so that traversing other zones adjacent the producing zones is avoided or at least substantially minimized. "Uphole" is used in the context of moving closer to the wellhead as a direction such as when the reference points are in a horizontal run.

The above description is illustrative of the preferred embodiment and many modifications may be made by those skilled in the art without departing from the invention whose scope is to be determined from the literal and equivalent scope of the claims below.

I claim:

1. A completion method for a wellbore extending from a surface, comprising:

providing at least three laterals from an existing wellbore;

providing downhole equipment to allow selective sequential access to said laterals without using a work string in the wellbore;

removing any drilling or completion rig from the surface at the wellbore;

fracking said laterals sequentially after removing said rig.

2. The method of claim 1, comprising:

sequentially delivering different plugs to land in said downhole equipment adjacent a predetermined lateral of said laterals.

3. The method of claim 1, comprising:

producing said laterals simultaneously after said fracking.

4. The method of claim 1, comprising:

providing each lateral subsequently produced at a higher location in the well than previously drilled laterals.

5. The method of claim 1, comprising:

spanning the exit of each lateral after a first lateral with a pair of packers and a ported sub in between for selective access to said straddled lateral.

6. The method of claim 2, comprising:

sequentially fracking all laterals with a pressure truck at the wellhead.

7. The method of claim 2, comprising:

producing said laterals simultaneously after said fracking.

8. A completion method, comprising:

drilling at least three laterals from an existing wellbore with a rig;

providing downhole equipment to allow selective sequential access to said laterals;

fracking said laterals sequentially;

spanning the exit of each lateral after a first lateral with a pair of packers and a ported sub in between for selective access to said straddled lateral;

sequentially delivering bigger plugs to actuate progressively higher ported subs to access laterals in sequence moving uphole for fracking.

9. The method of claim 8, comprising:

sequentially isolating laterals already fracked with each plug dropped.

10. The method of claim 9, comprising:

blowing a plug from a lowermost packer to obtain access to a lowermost lateral for fracking it.

11. A completion method for a wellbore extending from a surface, comprising:

providing at least two coplanar laterals in a wellbore;

providing downhole equipment to allow selective sequential access to said laterals without using a work string in the wellbore;

removing any drilling or completion rig from the surface at the wellbore;

fracking said laterals sequentially after removing said rig.

12. The method of claim 11, comprising:

sequentially delivering different plugs to land in said downhole equipment adjacent a predetermined lateral of said laterals.

13. The method of claim 11, comprising:

producing said laterals simultaneously after said fracking.

14. The method of claim 11, comprising:

exiting from a first lateral to create the second coplanar lateral.

15. The method of claim 11, comprising:

spanning the exit of each lateral after a first lateral with a pair of packers and a ported sub in between for selective access to said straddled lateral.

16. The method of claim 12, comprising:

sequentially fracking all laterals with a pressure truck at the wellhead.

17. The method of claim 12, comprising:

producing said laterals simultaneously after said fracking.

18. A completion method, comprising:

drilling at least two coplanar laterals in a wellbore with a rig;

providing downhole equipment to allow selective sequential access to said laterals;

fracking said laterals sequentially;

spanning the exit of each lateral after a first lateral with a pair of packers and a ported sub in between for selective access to said straddled lateral;

sequentially delivering bigger plugs to actuate progressively higher ported subs to access laterals in sequence moving uphole for fracking.

19. The method of claim 18, comprising:

sequentially isolating laterals already fracked with each plug dropped.

20. The method of claim 19, comprising:

blowing a plug from a lowermost packer to obtain access to a lowermost lateral for fracking it.

* * * * *